US010662817B2

(12) United States Patent
Takagi et al.

(10) Patent No.: US 10,662,817 B2
(45) Date of Patent: May 26, 2020

(54) STEAM TURBINE

(71) Applicants: KABUSHIKI KAISHA TOSHIBA, Minato-ku (JP); Toshiba Energy Systems & Solutions Corporation, Kawasaki-shi (JP)

(72) Inventors: Norikazu Takagi, Kawasaki (JP); Takahiro Ono, Ota (JP); Tsuguhisa Tashima, Yokohama (JP); Shogo Iwai, Ota (JP); Daichi Fukabori, Yokohama (JP)

(73) Assignees: KABUSHIKI KAISHA TOSHIBA, Minato-ku (JP); Toshiba Energy Systems & Solutions Corporation, Kawasaki-shi (JP)

( * ) Notice: Subject to any disclaimer, the term of this patent is extended or adjusted under 35 U.S.C. 154(b) by 234 days.

(21) Appl. No.: 15/818,817

(22) Filed: Nov. 21, 2017

(65) Prior Publication Data

US 2018/0142573 A1 May 24, 2018

(30) Foreign Application Priority Data

Nov. 24, 2016 (JP) ..... 2016-228290

(51) Int. Cl.
*F01D 25/28* (2006.01)
*F01D 25/26* (2006.01)

(52) U.S. Cl.
CPC ..... *F01D 25/28* (2013.01); *F01D 25/26* (2013.01); *F05D 2220/31* (2013.01); *F05D 2220/76* (2013.01); *F05D 2240/91* (2013.01); *F05D 2260/30* (2013.01)

(58) Field of Classification Search
CPC ..... F01D 25/26; F01D 25/28; F05D 2260/30; F05D 2220/31; F05D 2220/76; F05D 2240/91
USPC ..... 415/213.1
See application file for complete search history.

(56) References Cited

U.S. PATENT DOCUMENTS 3,773,431 A * 11/1973 Bellati ..... F01D 25/26 415/108
3,843,281 A 10/1974 Meylan et al.
5,290,146 A * 3/1994 Erber ..... F01D 25/28 415/213.1
5,779,435 A * 7/1998 Lageder ..... F01D 25/24 184/106

(Continued)

FOREIGN PATENT DOCUMENTS

JP S49-135006 A 12/1974
JP H09-013913 A 1/1997
JP H11-93616 A 4/1999

(Continued)

*Primary Examiner* — Christopher Verdier
(74) *Attorney, Agent, or Firm* — Oblon, McClelland, Maier & Neustadt, L.L.P.

(57) ABSTRACT

A steam turbine according to an embodiment includes an outer casing, an inner casing, a turbine rotor, and a pair of inner casing regulating portions. The pair of inner casing regulating portions regulates movement of the inner casing in a direction orthogonal to an axial direction of the turbine rotor. The pair of inner casing regulating portions is disposed beneath the inner casing at positions different from each other in the axial direction and is supported by a regulating supporting portion extending upward from a bottom portion of the outer casing.

10 Claims, 6 Drawing Sheets

(56) References Cited

U.S. PATENT DOCUMENTS

| | | | | |
|---|---|---|---|---|
| 2012/0009058 | A1* | 1/2012 | Floyd, II | F01D 25/28<br>415/213.1 |
| 2018/0142574 | A1* | 5/2018 | Ono | F01D 25/162 |

FOREIGN PATENT DOCUMENTS

| | | | |
|---|---|---|---|
| JP | 2000-356109 | A | 12/2000 |
| JP | 2001-82108 | A | 3/2001 |
| JP | 2012-112254 | A | 6/2012 |
| JP | 2014-231798 | A | 12/2014 |

* cited by examiner

STEAM TURBINE

CROSS-REFERENCE TO RELATED APPLICATIONS

This application is based upon and claims the benefit of priority from Japanese Patent Application No. 2016-228290, filed on Nov. 24, 2016; the entire contents of which are incorporated herein by reference.

FIELD

An embodiment of the present invention relates to a steam turbine.

BACKGROUND

A steam turbine plant is mainly provided with a high-pressure steam turbine in which main steam performs work; an intermediate-pressure steam turbine in which reheated steam performs work; and a low-pressure steam turbine in which steam discharged from the intermediate-pressure steam turbine performs work. Among these steam turbines, the low-pressure steam turbine is coupled to a condenser, and the steam discharged from the low-pressure steam turbine is condensed in the condenser so as to generate condensate.

An inner casing of the low-pressure steam turbine is provided with a plurality of nozzle diaphragms. A labyrinth packing is provided to an inner peripheral end of each nozzle diaphragm to prevent the steam from passing through regions between the nozzle diaphragms and a turbine rotor. Accordingly, it is possible to reduce detriment attributable to steam leakage, which leads to improvement in performance of the turbine.

The nozzle diaphragms receive a swirling force from the steam passing through turbine stages and receive a turning moment centering on a shaft center line of the turbine rotor. Accordingly, the inner casing may be displaced in a direction orthogonal to an axial direction of the turbine rotor (hereinafter referred to as an "axis-orthogonal direction"). In this case, the labyrinth packing or a part of a stationary unit comes into contact with the turbine rotor or a part of a rotary unit, which is a problem.

To solve such a problem, an outer casing of the low-pressure steam turbine is provided with a supporting member that restricts movement of the inner casing in the axis-orthogonal direction. If the low-pressure steam turbine is a lower exhaust turbine beneath which a condenser is connected, the supporting member is formed so as to extend in the axial direction (horizontal direction) of the turbine rotor from an end plate of the outer casing.

An example of the low-pressure steam turbine includes a turbine of lateral exhaust type (hereinafter referred to as an "lateral exhaust turbine"). A condenser is connected to a side of this lateral exhaust turbine. In a case where the supporting member extending in the horizontal direction from the end plate is used in this lateral exhaust turbine, there is a problem that the supporting member obstructs a steam flow. In this case, a pressure loss of the steam increases, which may degrade performance of the turbine.

DETAILED DESCRIPTION

A steam turbine according to an embodiment includes an outer casing; an inner casing housed in the outer casing; a turbine rotor penetrating the inner casing and the outer casing; and a pair of inner casing regulating portions provided inside the outer casing, the pair of inner casing regulating portions being configured to regulate movement of the inner casing in a direction orthogonal to an axial direction of the turbine rotor. The pair of inner casing regulating portions is disposed beneath the inner casing at positions different from each other in the axial direction and is supported by a regulating supporting portion extending upward from a bottom portion of the outer casing.

Hereinafter, a steam turbine according to an embodiment of the present invention will be described with reference to the drawings.

First Embodiment

A steam turbine according to a first embodiment will be described with reference to FIGS. 1 to 8. The steam turbine illustrated in the present embodiment is a low-pressure steam turbine coupled to a condenser, serving as a lateral exhaust turbine configured to discharge steam laterally toward the condenser. The low-pressure steam turbine is disposed on a foundation F.

Figures 1, 10:
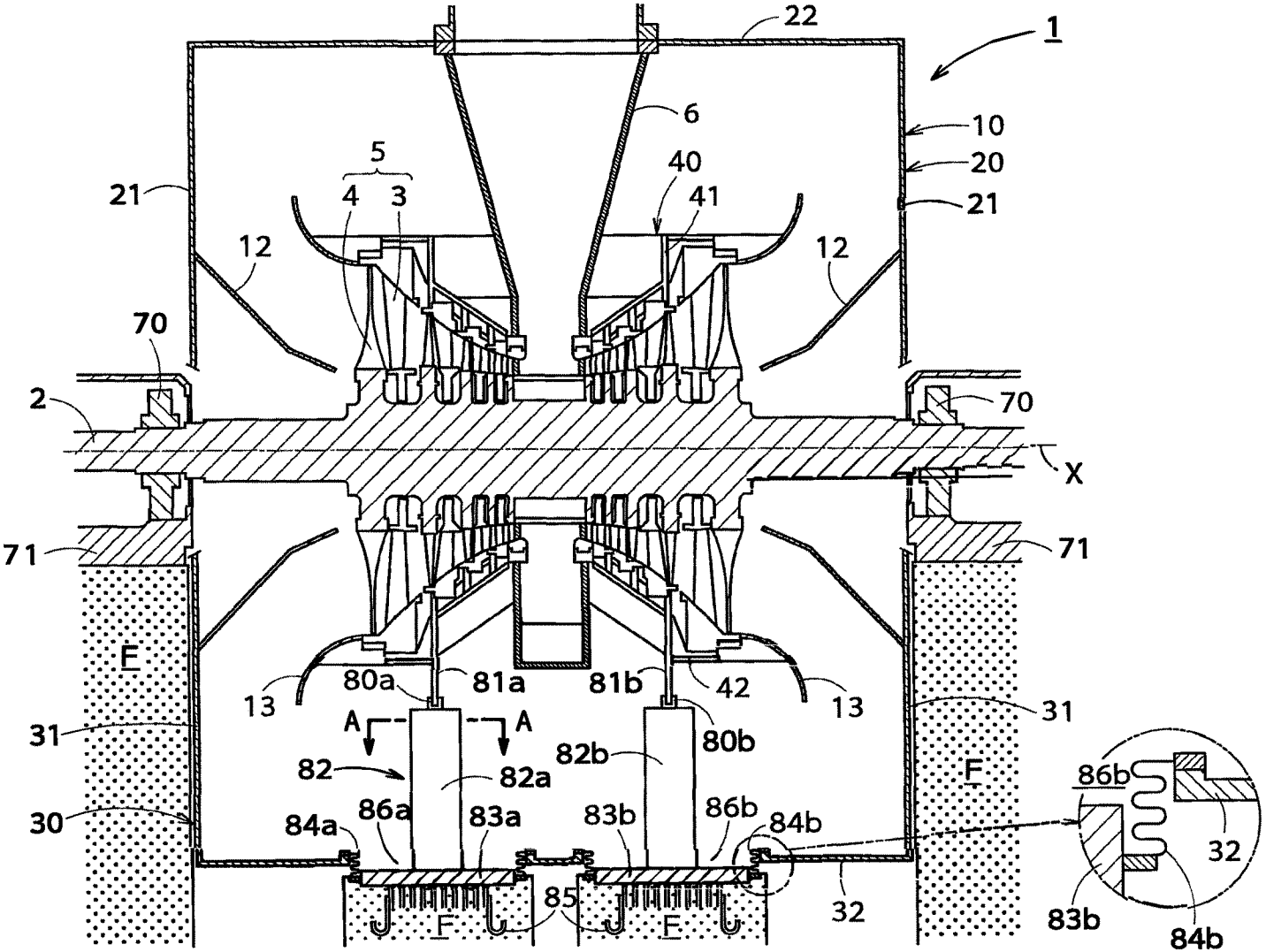
FIG. 1 is a vertical cross-sectional view illustrating a general arrangement of a steam turbine according to a first embodiment.
FIG. 10 is a partially enlarged view illustrating the second bellows of FIG. 1.

As illustrated in FIG. 1, a low-pressure steam turbine 1 (hereinafter simply referred to as a "steam turbine 1") includes an outer casing 10, an inner casing 40 housed in the outer casing 10, and a turbine rotor 2 penetrating the inner casing 40 and the outer casing 10. Among these components, the inner casing 40 is provided with a plurality of nozzle diaphragms 3. The plurality of nozzle diaphragms 3 is separated from each other in an axial direction of the turbine rotor 2. Mainly, the inner casing 40 and the nozzle diaphragms 3 are included in a stationary unit of the steam turbine 1. The turbine rotor 2 is provided with a plurality of rotor blades 4. The plurality of rotor blades 4 is separated from each other in the axial direction of the turbine rotor 2. Mainly, the turbine rotor 2 and the rotor blades 4 are included in a rotary unit of the steam turbine 1. Note that the axial direction of the turbine rotor 2 indicates a direction in which a shaft center line X of the turbine rotor 2 extends (a left-and-right direction in FIG. 1).

The nozzle diaphragms 3 and the rotor blades 4 are alternately arranged. One nozzle diaphragm 3 and one rotor blade 4 adjacent to this nozzle diaphragm 3 in a lower stream are included in one turbine stage 5. In the steam turbine 1 illustrated in FIG. 1, such a turbine stage 5 is provided plurally. A labyrinth packing (not illustrated) is provided to an inner peripheral end of each nozzle diaphragm 3. Accordingly, the steam is prevented from passing through regions between the nozzle diaphragms 3 and the turbine rotor 2 so as to reduce detriment attributable to steam leakage, which leads to improvement in performance of the turbine.

To the inner casing 40, a steam supply pipe 6 is connected. The steam supply pipe 6 guides steam supplied from an intermediate-pressure steam turbine or a boiler (not illustrated) to the turbine stage 5 in the uppermost stream. The steam then passes through each turbine stage 5 to perform work. Accordingly, the turbine rotor 2 is driven to rotate, and an electric generator (not illustrated) coupled to the turbine rotor 2 generates electricity.

The steam turbine 1 according to the present embodiment is a lateral exhaust turbine as described above. In other words, the outer casing 10 includes a lateral exhaust outlet 11 provided to a lateral end of the outer casing 10. The outer casing 10 is also provided with cones 12 to guide the steam that has passed through each turbine stage 5 to the lateral exhaust outlet 11. The cones 12 are formed so as to protrude toward the inside of the outer casing 10 from an upper half end plate 21 and a lower half end plate 31 which are to be mentioned. The inner casing 40 is provided with a diffuser 13 that guides a steam flow that has passed through each turbine stage 5. In this manner, the steam that has passed through each turbine stage 5 is allowed by the cones 12 and the diffuser 13 to flow inside the outer casing 10 toward the lateral exhaust outlet 11, thereby being discharged from the lateral exhaust outlet 11. The steam discharged from the lateral exhaust outlet 11 is supplied to a condenser (not illustrated) coupled to the steam turbine 1, being condensed in the condenser so as to generate condensate.

Figure 2:
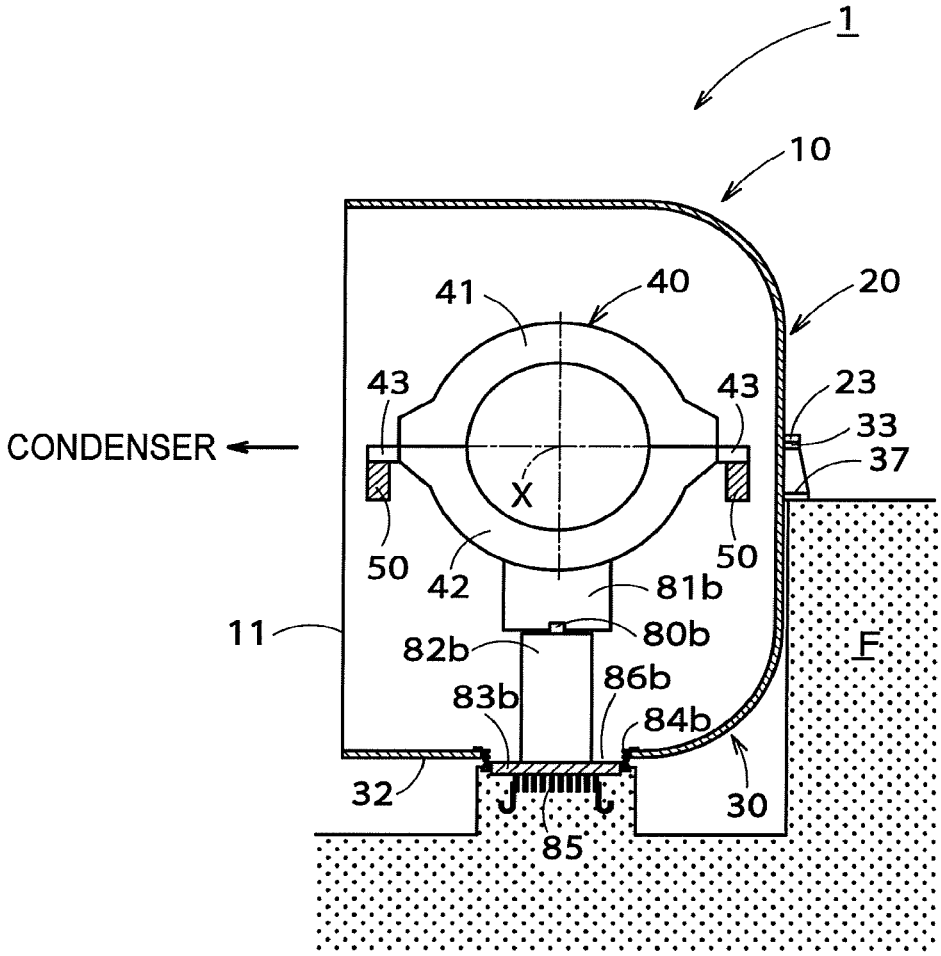
FIG. 2 is a cross-sectional side view illustrating the steam turbine of FIG. 1.

As illustrated in FIGS. 1 and 2, the outer casing 10 has an outer casing upper half 20 and an outer casing lower half 30. The outer casing 10 is divided into two in a vertical direction by a horizontal plane including the shaft center line X of the turbine rotor 2.

The outer casing upper half 20 includes a pair of upper half end plates 21 provided at both ends in the axial direction of the turbine rotor 2; a body of outer casing upper half 22 provided between the pair of upper half end plates 21; and an upper half flange 23. The upper half flange 23 is continuously provided to lower ends of the upper half end plates 21 and a lower end of the body of outer casing upper half 22.

On the other hand, the outer casing lower half 30 includes a pair of lower half end plates 31 provided at both ends in the axial direction of the turbine rotor 2; a body of outer casing lower half 32 provided between the pair of lower half end plates 31. A lower half flange 33 is continuously provided to upper ends of the lower half end plates 31 and an upper end of the body of outer casing lower half 32.

The upper half flange 23 of the outer casing upper half 20 and the lower half flange 33 of the outer casing lower half 30 are fastened to each other with a bolt and the like. Accordingly, the outer casing upper half 20 and the outer casing lower half 30 are combined.

Figure 3:
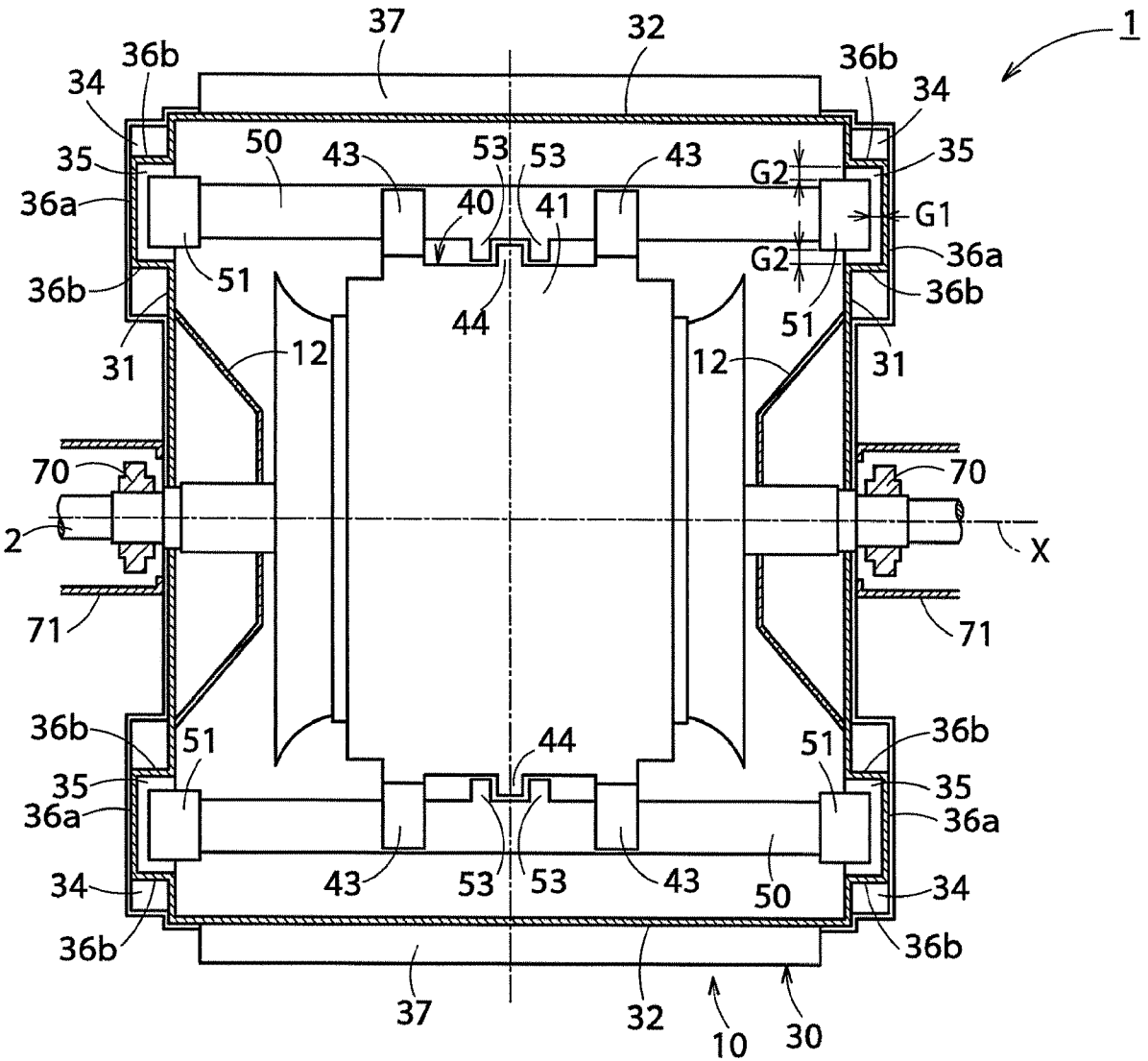
FIG. 3 is a horizontal cross-sectional view illustrating the steam turbine of FIG. 1.

As illustrated in FIG. 3, the outer casing lower half 30 of the present embodiment further includes a first foot plate 34 (outer casing supporting portion) provided to each of the lower half end plates 31. The first foot plates 34 are supported by the foundation F provided around the outer casing 10. More specifically, the first foot plates 34 are fixed to the foundation F to support the outer casing 10 on the foundation F. The first foot plates 34 are disposed on both sides with respect to the shaft center line X of the turbine rotor 2 as viewed from above. In the present embodiment, the outer casing lower half 30 includes four first foot plates 34.

As illustrated in FIG. 3, a pair of inner casing supporting beams 50 is provided inside the outer casing 10 to support the inner casing 40. The inner casing supporting beams 50 extend in the axial direction of the turbine rotor 2 (more specifically, they are parallel and horizontal to the shaft center line X of the turbine rotor 2). In other words, the inner casing supporting beams 50 have a longitudinal direction along the axial direction of the turbine rotor 2. In the present embodiment, the inner casing supporting beams 50 are disposed on both sides with respect to the shaft center line X of the turbine rotor 2 when viewed from above (both sides in the vertical direction in FIG. 3), being arranged close to the inner casing 40. More specifically, as viewed from above, the inner casing supporting beams 50 are disposed between the inner casing 40 and the body of outer casing lower half 32, being arranged closer to the inner casing 40 than body of outer casing lower half 32.

Figure 4:
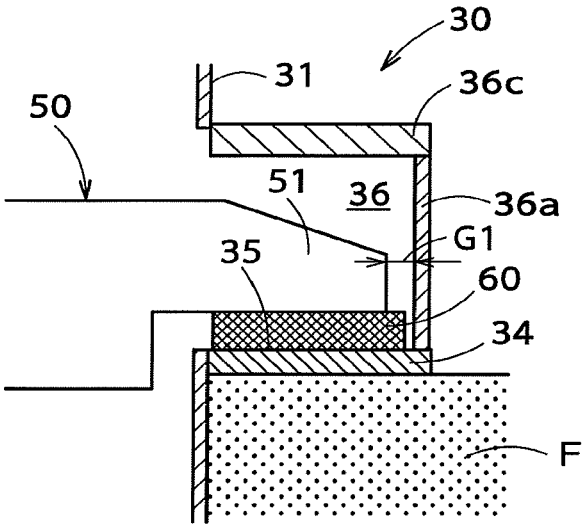
FIG. 4 is a partially enlarged cross-sectional view illustrating a beam end portion of an inner casing supporting beam illustrated in FIG. 2.

Each of the inner casing supporting beams 50 has beam end portions 51 provided at both ends in the axial direction of the turbine rotor 2. As illustrated in FIGS. 3 and 4, each of the first foot plates 34 includes a supporting surface 35 (an upper surface of each first foot plate 34) that supports the corresponding beam end portion 51. In the present embodiment, each of the beam end portions 51 is placed on the supporting surface 35 of the corresponding first foot plate 34. Accordingly, the inner casing supporting beams 50 are positioned at a height based on a foundation surface (an upper surface of the foundation F). Each of the beam end portions 51 is disposed on the corresponding supporting surface 35 slidably in the axial direction of the turbine rotor 2.

More specifically, as illustrated in FIGS. 3 and 4, an end housing space 36 is provided above each first foot plate 34 to house the corresponding beam end portion 51. The outer casing lower half 30 further includes first end walls **36*a*, pairs of second end walls 36*b*, and ceiling walls 36*c*. Each end housing space 36 is sectioned by the first foot plate 34, the first end wall 36*a*, a pair of second end walls 36*b*, and the ceiling wall 36*c*. Further, the end housing spaces 36 are formed into a recess with respect to an internal space of the outer casing 10 (in other words, they are formed into a projection protruding outward from the lower half end plates 31). Each first end wall 36*a* faces the corresponding beam end portion 51 in the axial direction of the turbine rotor 2. Each second end wall 36*b* faces the corresponding beam end portion 51 in a direction orthogonal to the axial direction of the turbine rotor 2 as viewed from above (hereinafter referred to as an "axis-orthogonal direction"). Each ceiling wall 36*c* is coupled to an upper end of the first end wall 36*a* and an upper end of the second end wall 36*b* so as to face the corresponding supporting surface 35. The supporting surfaces 35, the second end walls 36*b*, and the ceiling walls 36*c* are coupled to the lower half end plates 31. In this manner, the end housing spaces 36 are formed into a rectangular space, being configured to house the beam end portions 51. The first foot plates 34 are disposed on upper parts of the lower half end plates 31, but it should be noted that the first foot plates 34 are disposed at a position so as to form the end housing spaces 36 at positions lower than the lower half flange 33**.

As illustrated in FIGS. 3 and 4, a gap G1 is provided between each beam end portion 51 and the corresponding first end wall 36*a*. In this manner, each beam end portion 51 is configured not to be in contact with the first end wall 36*a*. The gap G1 is set to such a size that each beam end portion 51 does not come into contact with the first end wall 36*a* even when the outer casing 10 deforms due to a vacuum load or a load of the turbine rotor 2. Furthermore, a gap G2 is also provided between each beam end portion 51 and the corresponding pair of second end walls 36*b* so that each beam end portion 51 does not come into contact with the second end walls 36*b*.

Similar to the gap G1, the gap G2 is set to such a size that each beam end portion 51 does not come into contact with the second end walls 36*b* even when the outer casing 10 deforms.

As illustrated in FIG. 4, in the present embodiment, a low friction member 60 is interposed between each beam end portion 51 and the corresponding supporting surface 35. The low friction members 60 may be made of a low friction material such as Teflon (registered trademark), but is not limited thereto. For example, the low friction members 60 may be totally formed of a low friction material. Alternatively, the low friction members 60 may have a structure in which a metallic surface (at least an upper surface) shaped like a baseplate is coated with a low friction material.

As illustrated in FIGS. 1 and 2, the inner casing 40 includes an inner casing upper half 41 and an inner casing lower half 42. In other words, the inner casing 40 is divided into two in the vertical direction by the horizontal plane including the shaft center line X of the turbine rotor 2. As illustrated in FIGS. 2 and 3, the inner casing lower half 42 has four arms 43 supported by the inner casing supporting beams 50. The arms 43 extend in the axis-orthogonal direction, being formed to protrude outward from an upper end of the inner casing lower half 42. In the present embodiment, as illustrated in FIG. 3, two arms 43 are provided on each side with respect to the shaft center line X of the turbine rotor 2 as viewed from above.

As illustrated in FIG. 2, the inner casing supporting beams 50 are restricted to move in the axial direction with respect to a central part of the inner casing 40 in the axial direction of the turbine rotor 2. More specifically, the inner casing lower half 42 includes inner casing regulating portions 44. The inner casing regulating portions 44 are provided on both sides with respect to the shaft center line X of the turbine rotor 2 as viewed from above. The inner casing regulating portions 44 are disposed between the pair of arms 43 as viewed from above. More specifically, the inner casing regulating portions 44 are disposed in central positions of the inner casing 40 in the axial direction of the turbine rotor 2. Both sides in the axial direction of each inner casing regulating portion 44 are provided with portions to be regulated 53 of each inner casing supporting beam 50 so that the inner casing supporting beams 50 are restricted to move with respect to the inner casing 40 in the axial direction.

As illustrated in FIGS. 2 and 3, the outer casing lower half 30 further includes a second foot plate 37 provided on an outer surface of the body of outer casing lower half 32. The second foot plate 37 is supported by the foundation F provided around the outer casing 10. More specifically, the second foot plate 37 is fixed to the foundation F to support the outer casing 10 on the foundation F. The second foot plate 37 is disposed on one side with respect to the shaft center line X of the turbine rotor 2 when viewed from above. In other words, the second foot plate 37 is disposed on a side opposite to the lateral exhaust outlet 11, being disposed at a height similar to the first foot plates 34.

As illustrated in FIGS. 1 and 3, the turbine rotor 2 is rotatably supported by rotor bearings 70. The rotor bearings 70 are supported by a bearing base 71, and the bearing base 71 is supported by the foundation F provided around the outer casing 10. More specifically, the bearing base 71 is fixed to the foundation F to support the rotor bearings 70 on the foundation F. In this manner, in the present embodiment, the rotor bearings 70 are directly supported on the foundation F by the bearing base 71, not by the outer casing 10. Therefore, a height of the turbine rotor 2 is positioned at a height based on the foundation surface (the upper surface of the foundation F).

As illustrated in FIG. 1, a pair of inner casing regulating portions 80*a*, 80*b* is provided inside the outer casing 10. The pair of inner casing regulating portions 80*a*, 80*b* is disposed beneath the inner casing 40. A pair of plates to be regulated 81*a*, 81*b* (members to be regulated) is provided at a lower part of the inner casing lower half 42 of the inner casing 40. The pair of inner casing regulating portions 80*a*, 80*b* and the pair of plates to be regulated 81*a*, 81*b* are disposed at different positions in the axial direction of the turbine rotor 2. In the present embodiment, the pair of inner casing regulating portions 80*a*, 80*b* and the pair of plates to be regulated 81*a*, 81*b* are respectively disposed at symmetrical positions with respect to the center of the inner casing 40 in the axial direction. The pair of inner casing regulating portions 80*a*, 80*b* regulates the movement of the inner casing 40 in the axis-orthogonal direction, involving the corresponding plates to be regulated 81*a*, 81*b*. In other words, one of the inner casing regulating portions (a first inner casing regulating portion 80*a*) regulates the movement of one corresponding regulated plate (a first regulated plate 81*a*), and the other inner casing regulating portion (a second inner casing regulating portion 80*b*) regulates the movement of the other corresponding regulated plate (a second regulated plate 81*b*).

The pair of inner casing regulating portions 80*a*, 80*b* is supported by a regulating supporting portion 82 extending upward from a bottom portion of the body of outer casing lower half 32 of the outer casing lower half 30. In the present embodiment, the regulating supporting portion 82 includes a first vertical supporting beam 82*a* that supports the first inner casing regulating portion 80*a*; and a second vertical supporting beam 82*b* that supports the second inner casing regulating portion 80*b*. The first vertical supporting beam 82*a* and the second vertical supporting beam 82*b* are both formed to extend in the vertical direction.

Figure 5:
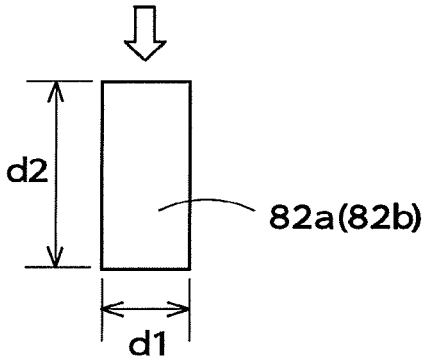
FIG. 5 is an example of a cross-sectional view taken along the line A-A in FIG. 1.
Figure 6:
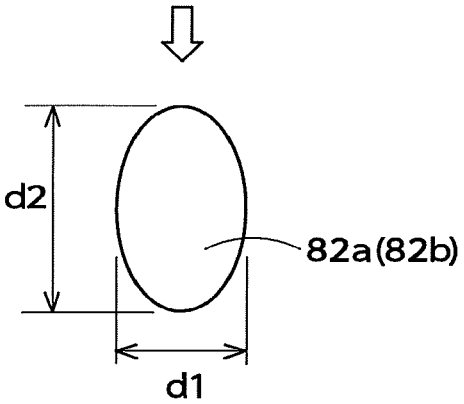
FIG. 6 is another example of the cross-sectional view taken along the line A-A in FIG. 1.

A projected area projected on a vertical plane of each of the vertical supporting beams 82*a*, 82*b* including the shaft center line X of the turbine rotor 2 is smaller than a projected area projected on a vertical plane vertical to the shaft center line X. In other words, as illustrated in FIGS. 5 and 6, in a horizontal cross section, a horizontal dimension d1 of the vertical supporting beams 82*a*, 82*b* in the axial direction of the turbine rotor 2 is smaller than a horizontal dimension d2 in the axis-orthogonal direction. Accordingly, part of a steam flow passing toward the lateral exhaust outlet 11 is prevented from being obstructed. Regarding the vertical supporting beams 82*a*, 82*b*, a horizontal cross-sectional shape is not particularly limited, but may be formed in, for example, a rectangular shape or an elliptical shape. In a case where the horizontal cross section of the vertical supporting beams 82*a*, 82*b* is formed in a rectangular shape, as illustrated in FIG. 5, a longitudinal direction of the horizontal cross section is preferably arranged along a steam flow passing toward the lateral exhaust outlet 11 (indicated by an arrow in the drawing). In a case where the horizontal cross section of the vertical supporting beams 82*a*, 82*b* is formed in an elliptical shape, as illustrated in FIG. 6, a long axis direction of the horizontal cross section is preferably arranged along the steam flow passing toward the lateral exhaust outlet 11. Furthermore, although it is not illustrated, the horizontal cross section of the vertical supporting beams 82*a*, 82*b* may be formed in a streamlined shape along the steam flow.

Similar to each of the vertical supporting beams 82*a*, 82*b*, a projected area projected on a vertical plane of each of the regulated plate 81*a*, 81*b* including the shaft center line X of the turbine rotor 2 is smaller than a projected area projected on a vertical plane vertical to the shaft center line X. In the present embodiment, the plates to be regulated 81*a*, 81*b* are formed in a flat plate shape, having a main surface arranged so as to face the axial direction of the turbine rotor 2.

As illustrated in FIGS. 1 and 2, each of the vertical supporting beams 82*a*, 82*b* is disposed beneath the inner casing 40 together with the plates to be regulated 81*a*, 81*b* and the inner casing regulating portions 80*a*, 80*b*. In other words, the plates to be regulated 81*a*, 81*b*, the inner casing regulating portions 80*a*, 80*b*, and the vertical supporting beams 82*a*, 82*b* are disposed so as to overlap with the inner casing 40 when viewed from above, being disposed so as not to overlap with the diffuser 13 of the inner casing 40, and a region between the upper half end plate 21 and the lower half end plate 31 of the outer casing 10.

The vertical supporting beams 82*a*, 82*b* are respectively attached to foundation fixing portions 83*a*, 83*b* fixed to the foundation F disposed around the outer casing 10. The foundation fixing portions 83*a*, 83*b* are attached to the bottom portion of the body of outer casing lower half 32 of the outer casing 10, involving an outer casing deformation-absorbing mechanism (a first bellows 84*a* and a second bellows 84*b*). More specifically, the first vertical supporting beam 82*a* is attached to the bottom portion of the body of outer casing lower half 32, involving the first foundation fixing portion 83*a* and the first bellows 84*a*, while the second vertical supporting beam 82*b* is attached to the bottom portion of the body of outer casing lower half 32, involving the second foundation fixing portion 83*b* and the second bellows 84*b*. See FIG. 10. The first foundation fixing portion 83*a* and the second foundation fixing portion 83*b* include fixing brackets 85 embedded in the foundation F, being fixed to the foundation F disposed around the body of outer casing lower half 32. The first bellows 84*a* and the second bellows 84*b* are an expansion joint capable of diminishing deformation of the outer casing 10.

The bottom portion of the body of outer casing lower half 32 is provided with a first opening 86*a* and a second opening 86*b*. The first foundation fixing portion 83*a* is provided to a lower side of the first opening 86*a*, and the first vertical supporting beam 82*a* extends upward from the first foundation fixing portion 83*a*, penetrating the first opening 86*a*. Similarly, the second foundation fixing portion 83*b* is provided to a lower side of the second opening 86*b*, and the second vertical supporting beam 82*b* extends upward from the second foundation fixing portion 83*b*, penetrating the second opening 86*b*.

Figure 7:
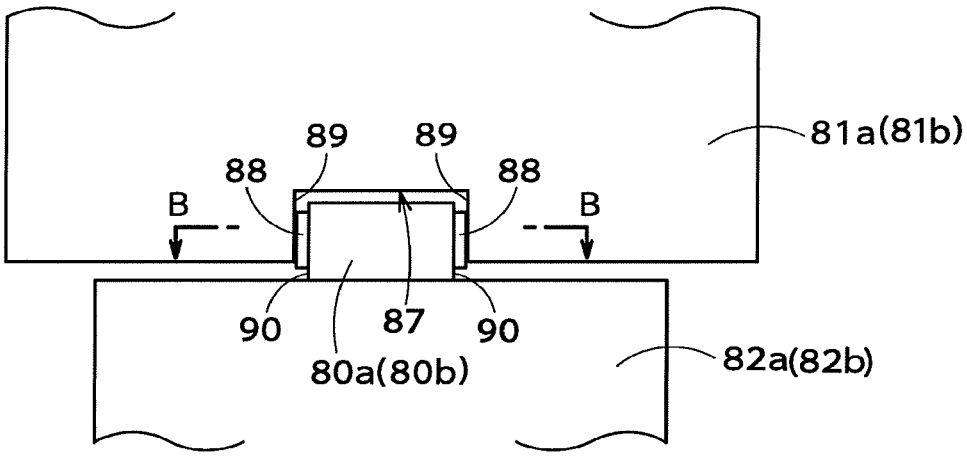
FIG. 7 is a partially enlarged view illustrating an inner casing regulating portion in FIG. 1 as viewed in an axial direction of a turbine rotor.

As illustrated in FIG. 7, each of the plates to be regulated 81*a*, 81*b* include an inner casing recess 87 to house the inner casing regulating portions 80*a*, 80*b*. When seen in the axial direction of the turbine rotor 2 (a direction vertical to paper of FIG. 7), each inner casing recess 87 is formed at a central part of a lower end of the plates to be regulated 81*a*, 81*b*, having a concave shape. The inner casing recesses 87 are formed so as to penetrate the plates to be regulated 81*a*, 81*b* in the axial direction.

As illustrated in FIG. 7, shims 88 are interposed between the inner casing regulating portions 80*a*, 80*b* and the plates to be regulated 81*a*, 81*b* in the axis-orthogonal direction (a left-and-right direction in FIG. 7). More specifically, the inner casing recesses 87 include a pair of recessed walls 89 facing the inner casing regulating portions 80*a*, 80*b* in the axis-orthogonal direction. The inner casing regulating portions 80*a*, 80*b* include a pair of regulating walls 90 facing the corresponding recessed walls 89. The shim 88 is interposed between each of the recessed walls 89 and the corresponding regulating wall 90. In this case, as a thickness or number of shims 88 is adjusted in accordance with a positional relationship between the plates to be regulated 81*a*, 81*b* and the inner casing regulating portions 80*a*, 80*b*, it is possible to diminish relative deviation between the recessed walls 89 and the regulating walls 90 when installing the inner casing 40 after fixing the vertical supporting beams 82*a*, 82*b* on the foundation. Such a situation facilitates installation of the inner casing 40. It should be noted that the shims 88 may be detachably fixed to the inner casing regulating portions 80*a*, 80*b* with a bolt and the like (not illustrated) in parts protruding from the inner casing recesses 87 in the axial direction of the turbine rotor 2 (that is, parts protruding upward and downward from the plates to be regulated 81*a*, 81*b* in FIG. 8). Alternatively, the shims 88 may be detachably held by the plates to be regulated 81*a*, 81*b*.

Figure 8:
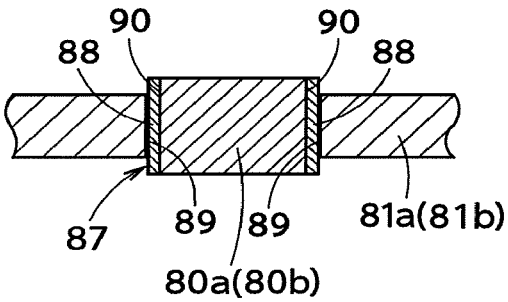
FIG. 8 is a cross-sectional view taken along the line B-B in FIG. 7.

As illustrated in FIG. 8, in the present embodiment, in the axial direction of the turbine rotor 2, the inner casing regulating portions 80*a*, 80*b* protrude from both end faces of the plates to be regulated 81*a*, 81*b* so as not to restrict the movement of the plates to be regulated 81*a*, 81*b* in the axial direction. In this case, a load in the axial direction of the turbine rotor 2 is not applied to the plates to be regulated 81*a*, 81*b*, the inner casing regulating portions 80*a*, 80*b*, and the vertical supporting beams 82*a*, 82*b*. Therefore, the plates to be regulated 81*a*, 81*b*, the inner casing regulating portions 80*a*, 80*b*, and the vertical supporting beams 82*a*, 82*b* can be decreased in a dimension in the axial direction, which reduces a pressure loss of the steam flow.

As illustrated in FIG. 7, in the vertical direction, a predetermined gap is provided between upper end faces of the inner casing recesses 87 and upper end faces of the inner casing regulating portions 80*a*, 80*b*. A predetermined gap is also provided between lower end faces of the plates to be regulated 81*a*, 81*b* and upper end faces of the vertical supporting beams 82*a*, 82*b*. In this manner, within these gaps, the plates to be regulated 81*a*, 81*b* are not restricted to move in the vertical direction. Therefore, when the inner casing 40 is displaced in the vertical direction due to thermal expansion and the like, the inner casing regulating portions 80*a*, 80*b* and the plates to be regulated 81*a*, 81*b* can move relatively. On the other hand, when the inner casing 40 is to be displaced in the axis-orthogonal direction due to thermal expansion and the like, bottom surfaces of the arms 43 supporting the inner casing 40 slide with respect to the inner casing supporting beams 50, designating the recessed walls 89 as starting points, which generates frictional force. This frictional force is applied, as reaction force when the inner casing 40 slides, to the vertical supporting beams 82*a*, 82*b* in the axis-orthogonal direction, involving the recessed walls 89, the shims 88, and the regulating walls 90. It is preferable that the vertical supporting beams 82*a*, 82*b* are rigid enough to keep from deforming against the reaction force (frictional force) in the axis-orthogonal direction.

Hereinafter described is a function of the present embodiment having such an arrangement.

In operating the steam turbine 1, steam passes through each turbine stage 5 and performs work. At this time, the nozzle diaphragms 3 receive a swirling force from the steam passing through the turbine stages 5 and receive a turning moment centering on the shaft center line X of the turbine rotor 2. However, the inner casing 40 according to the present embodiment is restricted by the inner casing regulating portions 80*a*, 80*b* to move in the axis-orthogonal direction. Accordingly, due to the turning moment received from the steam, it is possible to prevent contact between the labyrinth packing (not illustrated), a part of the stationary unit, provided to the inner peripheral end of each nozzle diaphragm 3 and the turbine rotor 2, a part of the rotary unit.

The steam that has passed through each turbine stage 5 flows through the outer casing 10 toward the lateral exhaust outlet 11. The steam that has passed through the lateral exhaust outlet 11 is supplied to the condenser (not illustrated) so as to be condensed.

The inner casing regulating portions 80*a*, 80*b* according to the present embodiment regulate the plates to be regulated 81*a*, 81*b* provided to a lower part of the inner casing 40. The vertical supporting beams 82*a*, 82*b* supporting these inner casing regulating portions 80*a*, 80*b* extend upward from the bottom portion of the body of outer casing lower half 32 of the outer casing 10. In this case, the plates to be regulated 81*a*, 81*b*, the inner casing regulating portions 80*a*, 80*b*, and the vertical supporting beams 82*a*, 82*b* are disposed beneath the inner casing 40. Therefore, it is possible to prevent the plates to be regulated 81*a*, 81*b*, the inner casing regulating portions 80*a*, 80*b*, and the vertical supporting beams 82*a*, 82*b* from being disposed in a region into which most of the steam that has passed through each turbine stage 5 flows. Thus, it is possible to prevent the steam flow from being obstructed by the plates to be regulated 81*a*, 81*b*, the inner casing regulating portions 80*a*, 80*b*, and the vertical supporting beams 82*a*, 82*b*, which reduces a pressure loss. In particular, the projected area projected on the vertical plane of each of the vertical supporting beams 82*a*, 82*b* including the shaft center line X of the turbine rotor 2 is smaller than the projected area projected on the vertical plane vertical to the shaft center line X. Accordingly, it is possible to reduce the pressure loss of the steam flow around the vertical supporting beams 82*a*, 82*b*.

Furthermore, in operation of the steam turbine 1, the internal space of the outer casing 10 is caused by the condenser to be in a vacuum state. In this case, the outer casing 10 may deform to recess inward. The outer casing 10 may also deform due to thermal expansion.

On the other hand, the vertical supporting beams 82*a*, 82*b* according to the present embodiment are attached to the bottom portion of the body of outer casing lower half 32, involving the foundation fixing portions 83*a*, 83*b* and the bellows 84*a*, 84*b*. Accordingly, the vertical supporting beams 82*a*, 82*b* are supported by the foundation fixing portions 83*a*, 83*b*, not by the body of outer casing lower half 32. Therefore, even when the outer casing 10 deforms due to a vacuum load and the like, it is possible to prevent the vertical supporting beams 82*a*, 82*b* from being affected by the deformation of the outer casing 10.

In the present embodiment, the beam end portions 51 of the inner casing supporting beams 50 are supported by the corresponding supporting surfaces 35 of the first foot plates 34 provided to the lower half end plates 31 of the outer casing lower half 30. Accordingly, the inner casing 40 can be supported by the foundation F without involving the body of outer casing upper half 22 or the body of outer casing lower half 32. Therefore, even when the outer casing 10 deforms due to the vacuum load and the like, the inner casing 40 is not affected by the deformation of the outer casing 10.

The rotor bearings 70 according to the present embodiment are supported by the foundation F through the bearing base 71. Accordingly, the rotor bearings 70 can be supported by the foundation F, not by the outer casing 10. Therefore, the turbine rotor 2 is not affected by the deformation of the outer casing 10 due to the vacuum load and the like. In addition, since the rotor bearings 70 are supported by the foundation F, the outer casing 10 will not receive a load from the turbine rotor 2.

In this manner, neither the inner casing 40 nor the turbine rotor 2 is affected by the deformation of the outer casing 10 due to the vacuum load and the like, and by the deformation of the outer casing 10 due to the load from the turbine rotor 2. Accordingly, a position of the inner casing 40 and a position of the turbine rotor 2 do not fluctuate. Therefore, it is possible to reduce the gap between the rotary unit and the stationary unit, and to maintain the gap between the rotary unit and the stationary unit regardless of a state of operation. In this case, it is possible to reduce detriment attributable to steam leakage and to improve performance of the turbine. Furthermore, it is possible to remove ribs provided to an inner surface of the outer casing 10 in a typical steam turbine to prevent the deformation of the outer casing 10, or it is possible to reduce the number and size of the ribs. In this case, it is possible to prevent the steam flow from being obstructed and to reduce the pressure loss, which leads to improvement in the performance of the turbine.

As described above, according to the present embodiment, the inner casing 40 is restricted by the inner casing regulating portions 80*a*, 80*b* to move in the axis-orthogonal direction. Accordingly, it is possible to prevent contact between the labyrinth packing, a part of the rotary unit, provided to the inner peripheral end of each nozzle diaphragm 3 and the turbine rotor 2, a part of the stationary unit. Thus, the rotary unit and the stationary unit can be prevented from coming into contact with each other.

Furthermore, according to the present embodiment, the inner casing regulating portions 80*a*, 80*b* are supported by the vertical supporting beams 82*a*, 82*b* extending upward from the bottom portion of the body of outer casing lower half 32 of the outer casing 10. Accordingly, it is possible to arrange the inner casing regulating portions 80*a*, 80*b* and the vertical supporting beams 82*a*, 82*b* beneath the inner casing 40. Thus, the steam flow passing through each turbine stage 5 can be prevented from being obstructed by the inner casing regulating portions 80*a*, 80*b*, and the vertical supporting beams 82*a*, 82*b*. As a result, the pressure loss of the steam can be reduced, and the performance of the turbine can be improved.

Still further, according to the present embodiment, the projected area projected on the vertical plane of each of the vertical supporting beams 82*a*, 82*b* including the shaft center line X of the turbine rotor 2 is smaller than the projected area projected on the vertical plane vertical to the shaft center line X. Accordingly, it is possible to prevent the steam around the vertical supporting beams 82*a*, 82*b* from being obstructed, which further reduces the pressure loss.

Still further, according to the present embodiment, the first inner casing regulating portion 80*a* is supported by the first vertical supporting beam 82*a* extending upward, while the second inner casing regulating portion 80*b* is supported by the second vertical supporting beam 82*b* extending upward. Accordingly, the first inner casing regulating portion 80*a* and the second inner casing regulating portion 80*b* can be supported by the turbine rotor 2 in different axial directions. Therefore, it is possible to efficiently restrict the inner casing 40 to move in the axis-orthogonal direction, which further prevents contact between the rotary unit and the stationary unit.

Still further, according to the present embodiment, the vertical supporting beams 82*a*, 82*b* are fixed on the foundation F respectively by the corresponding foundation fixing portions 83*a*, 83*b*, and the foundation fixing portions 83*a*, 83*b* are attached to the body of outer casing lower half 32 of the outer casing 10 with the bellows 84*a*, 84*b* involved. Accordingly, even when the outer casing 10 deforms due to the vacuum load or thermal expansion, it is possible to prevent the inner casing 40 from being displaced as being affected by the deformation of the outer casing 10. Thus, the rotary unit and the stationary unit can be further prevented from coming into contact with each other.

Still further, according to the present embodiment, the shims 88 are interposed between the inner casing regulating portions 80*a*, 80*b* and the plates to be regulated 81*a*, 81*b* in the axis-orthogonal direction. Accordingly, when the thickness or the number of shims 88 is adjusted, it is possible to reduce the gap between the inner casing regulating portions 80*a*, 80*b* and the plates to be regulated 81*a*, 81*b*, which further restricts the plates to be regulated 81*a*, 81*b* to move in the axis-orthogonal direction.

In the present embodiment, the inner casing 40 is described to be supported by the pair of inner casing supporting beams 50 provided inside the outer casing 10. However, the present invention is not limited to this embodiment, and the inner casing 40 may be supported by any structure as long as the inner casing 40 can be prevented from being displaced.

Second Embodiment

Next, a steam turbine according to a second embodiment of the present invention will be described with reference to FIG. 9.

Figure 9:
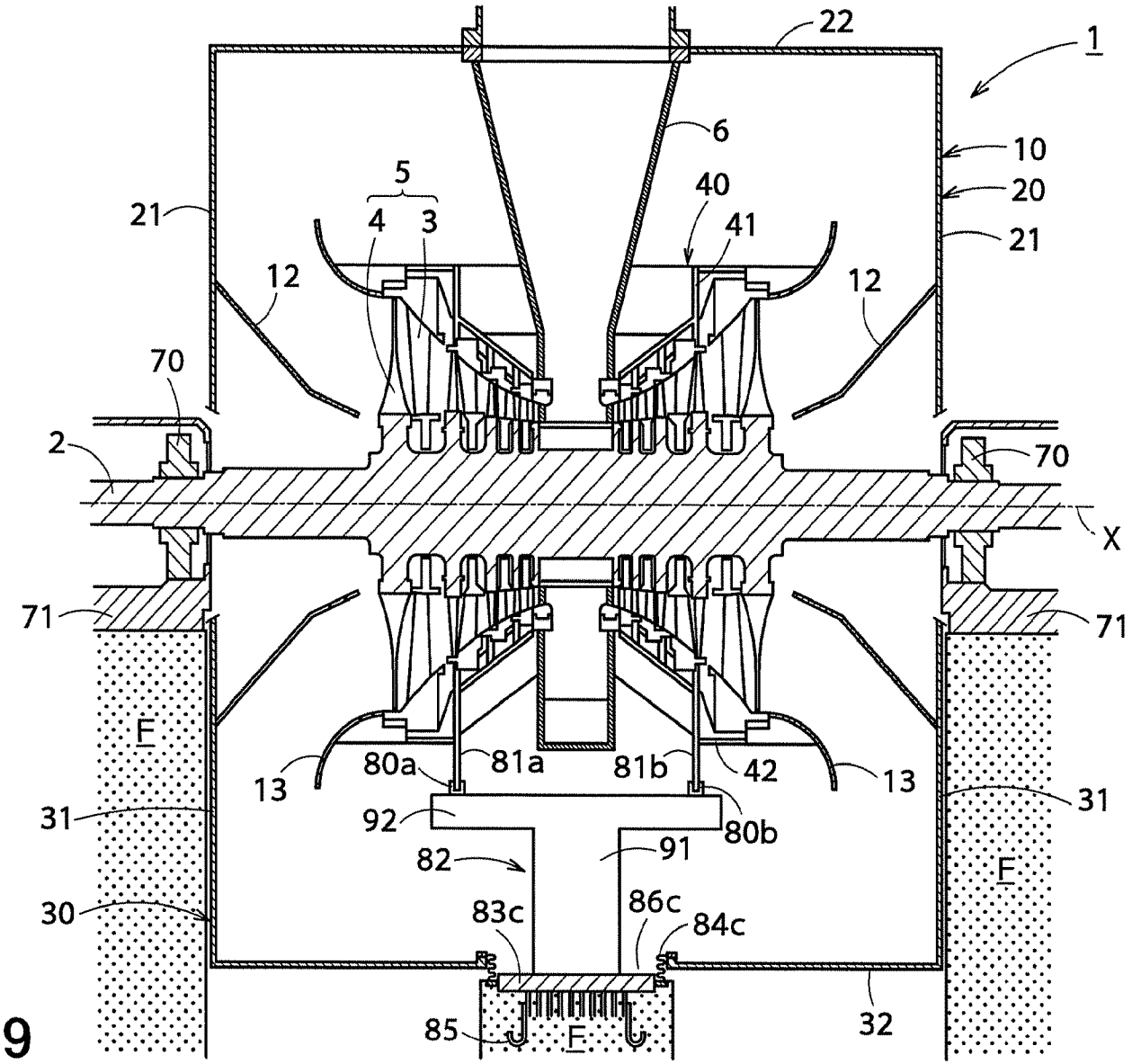
FIG. 9 is a vertical cross-sectional view illustrating a general arrangement of a steam turbine according to a second embodiment.

The steam turbine according to the second embodiment illustrated in FIG. 9 is different from the steam turbine according to the first embodiment illustrated in FIGS. 1 to 7 mainly in that a regulating supporting portion includes a common vertical supporting beam that supports both of a pair of inner casing regulating portions. Other structures in the steam turbine according to the second embodiment are substantially equivalent to those in the steam turbine according to the first embodiment. In FIG. 9, the same parts as those of the first embodiment illustrated in FIGS. 1 to 7 are denoted by the same reference numerals, and a detailed description thereof will be omitted.

As illustrated in FIG. 9, in the present embodiment, a regulating supporting portion 82 that supports a pair of inner casing regulating portions 80*a*, 80*b* includes a common vertical supporting beam 91 that supports both of the pair of inner casing regulating portions 80*a*, 80*b*. The common vertical supporting beam 91 is formed so as to extend in a vertical direction.

Similar to each of the vertical supporting beams 82*a*, 82*b* illustrated in FIG. 1 and the like, the common vertical supporting beam 91 is attached to a foundation fixing portion 83*c* fixed to a foundation F disposed around an outer casing 10. The foundation fixing portion 83*c* is attached to a bottom portion of a body of outer casing lower half 32, involving a bellows 84*c*.

The bottom portion of the body of outer casing lower half 32 is provided with an opening 86*c*. The foundation fixing portion 83*c* is provided to a lower side of the opening 86*c*. The common vertical supporting beam 91 extends upward from the foundation fixing portion 83*c*, penetrating the opening 86*c*.

Between the common vertical supporting beam 91 and the pair of inner casing regulating portions 80*a*, 80*b*, a transverse supporting beam 92 is interposed. The transverse supporting beam 92 extends in an axial direction of the turbine rotor 2, and the common vertical supporting beam 91 is coupled to an intermediate position of the transverse supporting beam 92. FIG. 8 illustrates an embodiment in which the common vertical supporting beam 91 and the transverse supporting beam 92 are formed in an integrated manner, but these members may be formed separately and then attached to each other. The inner casing regulating portions 80*a*, 80*b* are attached to both ends of the transverse supporting beam 92.

Similar to each of the vertical supporting beams 82*a*, 82*b* illustrated in FIG. 1 and the like, a projected area projected on a vertical plane of each of the common vertical supporting beam 91 and the transverse supporting beam 92 including the shaft center line X of the turbine rotor 2 is smaller than a projected area projected on a vertical plane vertical to the shaft center line X. The common vertical supporting beam 91 and the transverse supporting beam 92 are disposed beneath the inner casing 40. Among these beams, the common vertical supporting beam 91 is disposed at an intermediate position in the axial direction of the turbine rotor 2.

In this manner, in the present embodiment, the regulating supporting portion 82 that supports the pair of inner casing regulating portions 80*a*, 80*b* includes the common vertical supporting beam 91 that supports both of the pair of inner casing regulating portions 80*a*, 80*b*. Accordingly, it is possible to further reduce the projected area projected on the vertical plane including the shaft center line X of the turbine rotor 2 of the common vertical supporting beam 91. Therefore, regarding a steam flow that has passed through each turbine stage 5, it is possible to further restrict the steam flow from being obstructed by the common vertical supporting beam 91, which further reduces a pressure loss of the steam. Furthermore, employing the common vertical supporting beam 91 simplifies the structure. In other words, it is possible to reduce the number of the foundation fixing portion 83*c*, the bellows 84*c*, and the opening 86*c* of the body of outer casing lower half 32 required for attaching the common vertical supporting beam 91 to the body of outer casing lower half 32.

According to the aforementioned embodiment, it is possible to prevent contact between the rotary unit and the stationary unit, and to reduce the pressure loss of the steam, thereby improving the performance of the turbine.

While several embodiments of the invention have been described, these embodiments have been presented by way of example and are not intended to limit the scope of the invention. These novel embodiments can be implemented in various other forms, and various omissions, substitutions, and modifications can be made without departing from the gist of the invention. These embodiments and modifications thereof are included in the scope and gist of the invention as well as in the invention described in the claims and equivalent scopes thereof. As a matter of course, these embodiments can be partially combined within the scope of the gist of the present invention.

The invention claimed is:

1. A steam turbine configured to discharge steam laterally, the steam turbine comprising:

an outer casing;

an inner casing housed in the outer casing;

a turbine rotor penetrating the inner casing and the outer casing; and a pair of inner casing regulating portions provided inside the outer casing, the pair of inner casing regulating portions being configured to regulate movement of the inner casing in a direction orthogonal to an axial direction of the turbine rotor, wherein the pair of inner casing regulating portions is disposed beneath the inner casing at positions different from each other in the axial direction and is supported by a regulating supporting portion extending upward from a bottom portion of the outer casing, and the regulating supporting portion has a first projected area projected on a vertical plane including a shaft center line of the turbine rotor, the first projected area being smaller than a second projected area of the regulating supporting portion projected on a vertical plane orthogonal to the shaft center line.

2. The steam turbine according to claim 1, wherein the regulating supporting portion includes a first vertical supporting beam configured to support one of the pair of inner casing regulating portions, and a second vertical supporting beam configured to support the other of the pair of inner casing regulating portions.

3. The steam turbine according to claim 1, wherein the regulating supporting portion includes a common vertical supporting beam configured to support both of the pair of inner casing regulating portions.

4. The steam turbine according to claim 1, wherein the regulating supporting portion is attached to a foundation fixing portion fixed to a foundation disposed around the outer casing, and the foundation fixing portion is attached to the bottom portion of the outer casing, involving an outer casing deformation-absorbing mechanism.

5. The steam turbine according to claim 1, wherein the inner casing is provided with a pair of members to be regulated at a lower part of the inner casing, the inner casing regulating portions regulate the movement of the inner casing with the members to be regulated involved, each of the members to be regulated includes an inner casing recess to house the inner casing regulating portions, and a shim is interposed between each of the members to be regulated and the corresponding inner casing regulating portion in a direction orthogonal to the axial direction.

6. The steam turbine according to claim 1, further comprising an inner casing supporting beam provided inside the outer casing, the inner casing supporting beam being configured to support the inner casing.

7. The steam turbine according to claim 6, wherein the inner casing supporting beam extends in the axial direction, the outer casing includes outer casing supporting portions that are provided at both ends of the outer casing in the axial direction and are supported by a foundation, the inner casing supporting beam includes beam end portions provided at both ends in the axial direction, and each of the outer casing supporting portions includes a supporting surface that supports the corresponding beam end portion.

8. A steam turbine configured to discharge steam laterally, the steam turbine comprising:

an outer casing;

an inner casing housed in the outer casing;

a turbine rotor penetrating the inner casing and the outer casing; and a pair of inner casing regulating portions provided inside the outer casing, the pair of inner casing regulating portions being configured to regulate movement of the inner casing in a direction orthogonal to an axial direction of the turbine rotor, wherein the pair of inner casing regulating portions is disposed beneath the inner casing at positions different from each other in the axial direction and is supported by a regulating supporting portion extending upward from a bottom portion of the outer casing, and the regulating supporting portion includes a common vertical supporting beam configured to support both of the pair of inner casing regulating portions.

9. A steam turbine configured to discharge steam laterally, the steam turbine comprising:

an outer casing;

an inner casing housed in the outer casing;

a turbine rotor penetrating the inner casing and the outer casing; and a pair of inner casing regulating portions provided inside the outer casing, the pair of inner casing regulating portions being configured to regulate movement of the inner casing in a direction orthogonal to an axial direction of the turbine rotor, wherein the pair of inner casing regulating portions is disposed beneath the inner casing at positions different from each other in the axial direction and is supported by a regulating supporting portion extending upward from a bottom portion of the outer casing, the regulating supporting portion is attached to a foundation fixing portion fixed to a foundation disposed around the outer casing, and the foundation fixing portion is attached to the bottom portion of the outer casing, involving an outer casing deformation-absorbing mechanism.

10. A steam turbine configured to discharge steam laterally, the steam turbine comprising:

an outer casing;

an inner casing housed in the outer casing;

a turbine rotor penetrating the inner casing and the outer casing; and a pair of inner casing regulating portions provided inside the outer casing, the pair of inner casing regulating portions being configured to regulate movement of the inner casing in a direction orthogonal to an axial direction of the turbine rotor, wherein the pair of inner casing regulating portions is disposed beneath the inner casing at positions different from each other in the axial direction and is supported by a regulating supporting portion extending upward from a bottom portion of the outer casing, the inner casing is provided with a pair of members to be regulated at a lower part of the inner casing, the inner casing regulating portions regulate the movement of the inner casing with the members to be regulated involved, each of the members to be regulated includes an inner casing recess to house the inner casing regulating portions, and a shim is interposed between each of the members to be regulated and the corresponding inner casing regulating portion in a direction orthogonal to the axial direction.

* * * * *